United States Patent [19]

Collina

[11] Patent Number: 4,607,969

[45] Date of Patent: Aug. 26, 1986

[54] PRINTER WITH SHEET FRONT LOADER

[75] Inventor: Giancarlo Collina, Cermenate, Italy

[73] Assignee: Honeywell Information Systems Italia, Milan, Italy

[21] Appl. No.: 666,705

[22] Filed: Oct. 31, 1984

[30] Foreign Application Priority Data

Nov. 23, 1983 [IT] Italy ..... 23834 A/83

[51] Int. Cl.[4] ..... B41J 13/14

[52] U.S. Cl. ..... 400/642; 400/693

[58] Field of Search ..... 400/642, 607.2, 48, 400/645.1, 715, 603, 607, 608.4, 691, 693, 646, 647, 647.1, 717, 613.2; 211/49.1, 12; 355/14 SH; 271/9, 8.1; 209/534, 900; 346/104, 134, 82–86

[56] References Cited

U.S. PATENT DOCUMENTS

| | | | |
|---|---|---|---|
| 1,617,450 | 2/1927 | Knee | 400/603 |
| 1,634,726 | 7/1927 | Reischl | 400/691 |
| 4,226,547 | 10/1980 | Bradshaw et al. | 400/613 |

FOREIGN PATENT DOCUMENTS

| | | | |
|---|---|---|---|
| 0089287 | 9/1983 | European Pat. Off. | 400/642 |

OTHER PUBLICATIONS

The American Heritage Dictionary, Second College Edition, Houghton Mifflin, Boston, MA, 1982, p. 424.

*Primary Examiner*—Charles A. Pearson

*Attorney, Agent, or Firm*—Nicholas Prasinos; John S. Solakian

[57] ABSTRACT

A sheet front loading printer comprising a printer body with a chute beneath the body and having the inner portion bent upwards in order to guide a sheet inserted therein up to the platen. The platen also doubles as a sheet feeding device. To allow the use of sheets having a dimension less than the one defined by the path of the bottom of the chute, the chute is provided with at least one elongated opening or indentation and an arrangement of the printer supports which allows the printer to rest on a working plane. This permits further advancement of the sheet by manual action performed by the operator through the opening in the bottom of the chute.

3 Claims, 2 Drawing Figures

PRINTER WITH SHEET FRONT LOADER

BACKGROUND

1. Field of the Invention

The present invention relates to a printer with sheet front loader.

2. Description of the Prior Art

Low cost fast printers for data processing systems are available on the market. According to the most recent trends such printers may use both continuous form feeding with lateral perforations and discrete sheets. For these type printers a problem exists in loading the equipment with discrete single sheets by means of simple and fast operations and low cost devices. An example of a method for loading printers with individual sheets is the one used in typewriters. It consists of inserting a sheet between a feed roll, which also acts as a platen, and pressure rollers. An operation then follows which puts the pressure rollers near the feed roll in order that the sheet can be gripped between the feed roll and pressure rollers, which is further followed by an operation for manually moving the feed roll by knobs so as to bring the desired sheet in the desired position. This process requires a reatively long time.

Automatic sheet feeding devices are also used which perform a top feeding of the sheet. In other words, the sheet is inserted from the top in a suitable housing and some feeding rolls automatically lead the sheet downwards and provide for its advance, in an opposite direction when the printing of each of the several rows is performed. Suitable sensors generate signals according to the position of the sheet and control the feeding rollers. A feeding device of this type is disclosed in European Pat. No. 0024662. These feeding devices, though efficacious are relatively expensive and require a bidirection control of the feeding rolls.

The "front end" loading devices for single sheets, recently put on the market, overcome such disadvantages. These devices have a plate which acts as a frontally open chute where the sheets can be inserted. The back part of the chute is bent upwards acting as a guide which leads the sheet towards the feeding roller and facilitates its insertion between feeding roll and pressure rollers. When the sheet contacts the feeding roll, sensors are activated which start the feeding roll movement. The feeding roll then provides a suitable advance of the sheet upwards. A feeding device of this type is disclosed by U.S. Pat. No. 4,302,116. This kind of device is particularly simple, efficacious and inexpensive, but it is cumbersome because of the chute which must have a frontally receiving throat wide enough to allow easy handling of the sheet. Lacking such throat it is necessary to use sheets having a length adequate for the chute length. In fact, when the sheets are positioned into the chute and the upper edge of a sheet contacts the feeding roll, it is necessary for the back edge of the sheet to be accessed from the outside in order to allow the manual manipulation of the sheet towards the inside of the chute. Such restriction can be reduced by cutting to a minimum the distance between the frontal opening of the chute and the line where the sheet will contact the feeding roll. This can be obtained by keeping to a minimum the horizontal and vertical paths of the chute; that is, the printer body has to be ideally divided in forward/upper position containing only the printing devices and a back/lower portion, the two portions being separated by the chute, thus causing evident construction complications. With this type of device standard size sheets ISO A4 (21×29.7 cm) or of corresponding standard size sheets used in the U.S.A. (21.6×28 cm) can be used and fed in the direction of their greater dimension. However the printer size and the corresponding length of the chute prevent the feeding of the sheets in the direction of the sheet width. In other words, though the printers available on the market are able to print on a sheet having a width of more than 30 cm. a correct insertion in the chute of the sheets in the direction of their smaller dimension cannot be made. It is desirable, therefore, to print on discrete sheets of standard size which can be fed with either dimension.

OBJECTS OF THE INVENTION

It is a primary object of the invention to provide an improved printing feeder mechanism.

Another object of the invention is to provide a mechanism for feeding sheets with its larger dimension first or shorter dimension first.

SUMMARY OF THE INVENTION

The invention with front end sheet loading makes this possible. According to the invention the printer is provided with a frontal feeding chute underneath the printer and supplied with lower openings or grooves which permit manual manipulation of the sheet through the chute bottom towards the inner part of the chute, even though the sheet is completely inserted in the chute.

BRIEF DISCUSSION OF THE DRAWINGS

These and other features will appear more clearly from the following description of a preferred embodiment of the invention and from the enclosed drawings where:

DISCUSSION OF THE PREFERRED EMBODIMENT

Figure 1:
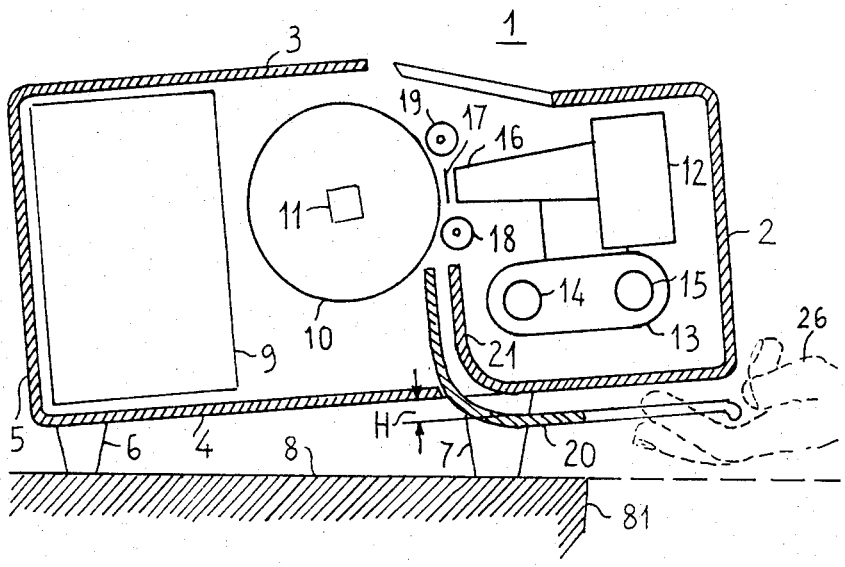
FIG. 1 shows, in side view and in median section, a printer provided with a sheet front end loader according to the invention.

FIG. 1 shows a sectional lateral view of a printer provided with sheet front-end feeder according to the invention. The general structure of the printer is conventional and is comprised of a body or box 1 generally shaped as a rectangular parallelepiped having a fore side 2, an upper side 3, a bottom side 4, a back side 5 and two side walls not shown. Bottom side 4 is provided with two pairs of supports 6, 7 for supporting the printer on a working plane or table 8. Inside the body, generally in the back portion, some electronic circuits for the supply and the control of the printer are housed, schematically shown as box 9. A platen or printing roll 10 is splined on a shaft 11 arranged parallel to the printer fore side 2. Platen 10 rotates on shaft 11 and motor means (not shown) is controlled by printing electronic circuits 9. A printing head 12, of the needle kind, is mounted on carriage 13 axially sliding on two driving bars 14, 15 parallel to platen 10. The movement of carriage 13 along the driving bar is caused by movers (not shown) controlled by printing electronic circuits 9. Printing head 12 is provided with a printing nose 16, which slides next to platen 10 during the carriage 13 movement. An inked ribbon 17 is inserted between nose 16 and platen 10. In order to perform printing operations the sheet must be arranged on the platen between the platen and the ribbon. The sheet is generally pressed against the platen by one or more pressure roller sets mounted on one or more shafts parallel to the platen. In FIG. 1 two pressure rollers 18, 19 are shown mounted on two separate shafts arranged in an upper and in a lower position in relation to the ribbon. When the sheet is inserted between platen and pressure rollers, the platen rotation, controlled by electronic circuits 9, causes the advance of the sheet. Generally the shafts on which the pressure rollers are mounted are placed on suitable supports in order to enable, in an automatic or manual way, the removal of the pressure rollers from the platen. This removal permits easier insertion of the sheet between the platen and the rollers.

Figure 2:
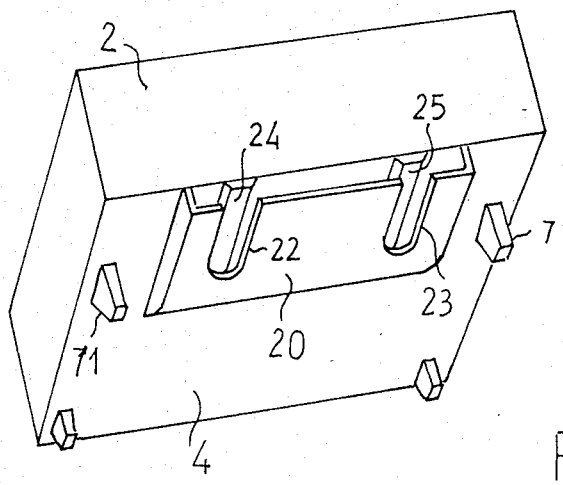
FIG. 2 shows in perspective view a printer provided with sheet front end loader according to the invention.

This structure is utilized as a basis for the invention. A sheet front end loader essentially comprised of a chute with reduced heighth; i.e., smaller than 1 cm., is arranged in a lower position relative to the printer body. The chute is comprised of a bottom 20 of plastic material or metal plate, a portion of which is bent, and which terminates inside the printer body near the contact line between platen 10 and pressure roller 18. For this purpose the bottom 4 of the printer has a suitable opening. Moreover its forward portion is bent upwards to form an edge 21. In this way a thin bent channel is formed which enables manual manipulation of the sheet inserted into the drawer, manually forcing it up to platen 10. In order to allow easy insertion of the sheet into the chute by an operator standing in front of the printer, bottom 20 extends to the printer fore plane so as to have the insertion slit or chute front clearly in the line of sight of the operator. In this way bottom 20 of the chute provides a suitable support and driving plane for the inserted sheet. Further, as evidenced by FIG. 2, bottom 20 has a pair of elongated indentations 22, 23 of suitable width extending towards the rear portion of the chute. These indentations may also be holes or elongated openings. In this way, though the sheet is completely inserted into the chute, the operator can still manipulate the sheets and apply pressure with his fingers through such indentations for advancing the sheet towards the inside of the chute. (In FIG. 1, the operator's hand is shown by a dotted line and referenced with numeral 26.) To eliminate the possibility that roughness of the printer bottom makes it difficult to advance the sheet, it is provided with suitably smooth and projecting guide shoes 24, 25 arranged opposite to indentations 22, 23 and elongated in the feeding direction of the sheet. To permit further advance of the sheet by the operator in a simple way, the invention is provided with supports 7, 71 (FIG. 2) which may be about 3 cm. high to permit the insertion of the operator's fingers between bottom 4 of the printer and the working plane.

In alternative to providing forward bearing supports 7, 71 having a height permitting the insertion of the operator fingers between bottom 4 of the printer and the working plane, the forward bearing supports 7, 71 of the printer; that is, the ones nearest to the printer front side, may be located slightly back in relation to the printer forward side of about 8, 10 cm. This allows the printer positioning on the working plane with the forward portion projecting relative to the forward corner 81 of the working plane by about 6–8 cm.

These arrangements besides enabling the front loading of a single sheet in the direction of their lesser dimension, provide for a simple and compact printing structure where a minimum body volume is used to enable the front loading (only the vertical portion of the chute) and where better modular body partitioning is achieved, the body being divided in a rear portion, containing the control electronic circuits, the platen and the related movers, and a fore portion containing the printing devices.

What is claimed is:

1. A printer with sheet front end loader, having a body with a bottom and a front end and feeding means in said body to advance a sheet on a platen, characterized in that said front end loader comprises a chute placed below the bottom of the printer body, said chute being formed by a bottom plate extending up to the body front end and having at least an opening or indentation elongated perpendicularly to the front end, said bottom of the printer body having a smooth shoe projecting from said bottom opposite to said opening or indentation in order to allow, through said opening or indentation, further manual advancement of a sheet towards a rear position of the chute, when said sheet is inserted in the chute, by exerting a pressure on said sheet, through said opening or indentation, against said shoe.

2. A printer as per claim 1 characterized in that it comprises forward bearing supports of a height not less than 1,5 cm., to allow the easy insertion of the operator's fingers between a working plane and said bottom plate, when the printer rests on said working plane.

3. A printer as per claim 1 characterized in that it comprises forward bearing supports located at least 6 cm. behind the front end of said body to allow the placing of such printer on a flat working surface having a front edge with said front end protruding at least 6 cm. beyond the front edge of said flat working surface.

* * * * *